US006328579B1

(12) United States Patent
Mori et al.

(10) Patent No.: US 6,328,579 B1
(45) Date of Patent: Dec. 11, 2001

(54) ELECTROMAGNETIC SHIELD CONNECTION MECHANISM

(75) Inventors: Shigeo Mori; Satoki Masuda; Shigemi Hashizawa, all of Shizuoka (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 09/487,898

(22) Filed: Jan. 19, 2000

(30) Foreign Application Priority Data

Jan. 21, 1999 (JP) ..... 11-012834

(51) Int. Cl.[7] ..... H01R 4/66
(52) U.S. Cl. ..... 439/97; 439/607; 439/939
(58) Field of Search ..... 439/92, 95, 97, 439/564, 573, 607, 939

(56) References Cited

U.S. PATENT DOCUMENTS

Re. 29,752 * 9/1978 Jaconette ..... 439/97
5,108,296 * 4/1992 Takano et al. ..... 439/92
5,616,052 * 4/1997 Pan et al. ..... 439/573
6,149,463 * 11/2000 Hashizawa et al. ..... 439/607

FOREIGN PATENT DOCUMENTS 8-64306 3/1996 (JP) .

* cited by examiner

*Primary Examiner*—Khiem Nguyen
(74) *Attorney, Agent, or Firm*—Armstrong, Westerman, Hattori, McLeland & Naughton, LLP

(57) ABSTRACT

An electromagnetic shield connection mechanism according to the present invention is for a structure in which a housing wall is fixed to a equipment by inserting a bolt through a collar fitted in a hole formed on the housing wall. The electromagnetic shield connection mechanism according to the present invention is characterized in that a contact member connected to a metal shield lies between the collar and the equipment so that the collar presses the contact member tightly against the equipment, resulting in that a secure electromagnetic shielding is always achieved by thus improved contact between the metal shield and the equipment.

15 Claims, 8 Drawing Sheets

ELECTROMAGNETIC SHIELD CONNECTION MECHANISM

BACKGROUND OF THE INVENTION (1) Field of the Invention

This invention relates to an electromagnetic shield connection mechanism that brings a shielding portion of a connector into tight electric contact with an equipment side.

(2) Description of the Related Art

In FIGS. 11 and 12, there is shown a conventional electromagnetic shield connection mechanism disclosed in Japanese Patent Application Laid-Open H8-64306. In the mechanism, a cylindrical metal shield (not shown) is inserted into a connector housing 91 made of synthetic resin and a contact piece 93 of the metal shield is exposed from a housing wall 92 at the bottom of the housing 91, thereby allowing the contact piece 93 to contact with an electric equipment 94 (i.e. mating side).

Inside the connector housing 91, there is formed a cylindrical part (not shown) which receives a female terminal (not shown) therein. A terminal base 95 protrudes from the housing wall 92 toward the equipment side for being connected with an electric circuit of the equipment side. On the housing wall 92, there are formed a ring-shaped groove 97 fitting an waterproof packing 96 therein and the contact piece 93 of the metal shield located inside the groove 97.

The housing wall 92 of the connector housing 91 is fixed to the equipment 94 by bolts 98, and simultaneously, the contact piece 93 is brought into contact with a connecting face (grounded) of a wall of the equipment 94. The packing 96 is pressed into the groove 97 of the housing wall 92 and a groove 99 of the equipment 94, thereby waterproofing the contact piece 93 and the terminal base 95. The metal shield prevents noises from coming into the terminal 95. Thus, a direct-mount type connector 100 is composed of the connector housing 91, the metal shield, the terminal and the waterproof packing 96.

However, regarding the above conventional mechanism for electromagnetic shield connection, since the housing wall 92 is made of synthetic resin, the housing wall 92 is bent or deformed due to a repulsion force of the packing 96, and so on, when a significant amount of heat is applied to the housing wall 92 for a long period of time, causing a problem that contact between the contact piece 93 of the metal shield and the contacting face of the wall of the equipment 94 becomes inferior. Even if a spring characteristic is given to the contact piece 93 in order to absorb the deformation of the housing wall, no sufficient contact force is available because of the nature of the material (for example, aluminum alloy) used as the contacting face of the wall of the equipment 94, such as a central processing unit case, i.e. a unit case of an equipment.

In FIG. 13, there is also shown a conventional electromagnetic shield connection mechanism disclosed in Japanese Patent Application Laid-Open H8-64306. In the mechanism, a terminal 102 having wires is received into a cylindrical housing 101 having a flange made of synthetic resin, a cylindrical metal shield 103 is formed into one united body with the housing 101 therein, and a flange of the metal shield 103 is fixed to a wall of an equipment 105 together with a flange 104 of the housing 101 using bolts 106, thereby making a contact between the metal shield 103 and the equipment 105.

A core 113 of a shielded wire 107 is crimp-connected to one side of the terminal 102, and a terminal 109 of a wire

108 of the equipment side is rigidly connected to another side of the terminal 102 using a bolt 110. A braided shield 111 of the shielded wire 107 is connected to the metal shield 103 via a holder 112.

However, regarding the above conventional mechanism for electromagnetic shield connection, since the housing 101 made of synthetic resin lies between the metal shield 103 and the terminal 102, a tightening force by the bolts 106 is deteriorated as the housing 101 and the flange 104 become thin when heat, vibration and impact are applied continuously, causing a problem that a contact between the metal shield 103 and the equipment 105 becomes inferior.

It is therefore an object of the present invention to solve the above-mentioned problems that the contact between the metal shield and the equipment side becomes inferior due to the deformation of the housing wall and/or an oxidation of the connection face of the equipment side, and to provide an electromagnetic shield connection mechanism enabling the secure electromagnetic shielding to be always achieved by improving the contact between the metal shield and the equipment side.

SUMMARY OF THE INVENTION

An electromagnetic shield connection mechanism according to the present invention is for a structure in which a housing wall is fixed to an equipment by inserting bolts through a collar fitted in holes formed on the housing wall.

In order to accomplish the above object, a first aspect of the present invention is to provide an electromagnetic shield connection mechanism characterized in such a manner that a contact member lies between the collar and the equipment so that the collar presses the contact member against the equipment.

A second aspect of the present invention is to provide the electromagnetic shield connection mechanism, wherein an electrically conductive layer on a surface of the housing is kept in contact with the contact member.

A third aspect of the present invention is to provide the electromagnetic shield connection mechanism, wherein the contact member has a pair of plates faced with each other, the one plate having a collar-receiving hole, the other plate having a bolt-receiving hole, and the each plate is kept in contact with the each corresponding surface of the housing wall.

A fourth aspect of the present invention is to provide the electromagnetic shield connection mechanism, wherein the contact member is mounted at three spots of the housing wall.

A fifth aspect of the present invention is to provide the electromagnetic shield connection mechanism, wherein the contact member having a bolt-receiving hole is unitedly shaped together with a metal shield.

A sixth aspect of the present invention is to provide the electromagnetic shield connection mechanism, wherein the metal shield is connected to a shielding portion of a shielded wire.

A seventh aspect of the present invention is to provide the electromagnetic shield connection mechanism, wherein the collar is composed of a flange part and a cylindrical part.

A eighth aspect of the present invention is to provide the electromagnetic shield connection mechanism, wherein a hollow for a scrap to be collected therein is provided at a press-fitting end of the collar.

According to the main aspect of the present invention, the collar presses the contact member connected to a metal shield tightly against the equipment by fastening a bolt, resulting in that a secure electromagnetic shielding is always achieved by the improved contact between the metal shield and the equipment. Even if the housing wall of the connector and the equipment wall are deformed caused by substantial heat, the electromagnetic shield connection quality does not deteriorate since the collar always presses the contact member against the equipment. Further, the contact member is closely fixed with the equipment without leaving an opening therebetween so that a possible oxidation of the equipment surface, such as an aluminum surface, is prevented, resulting in that no deterioration in quality of the electromagnetic shielding take place for a long time.

DESCRIPTION OF THE PREFERRED EMBODIMENTS

In the following, the preferred embodiments of the present invention are explained with reference to the attached drawings.

FIGS. 1 to 6 illustrate the first example of an electromagnetic shield connection mechanism according to the present invention.

Figure 1:
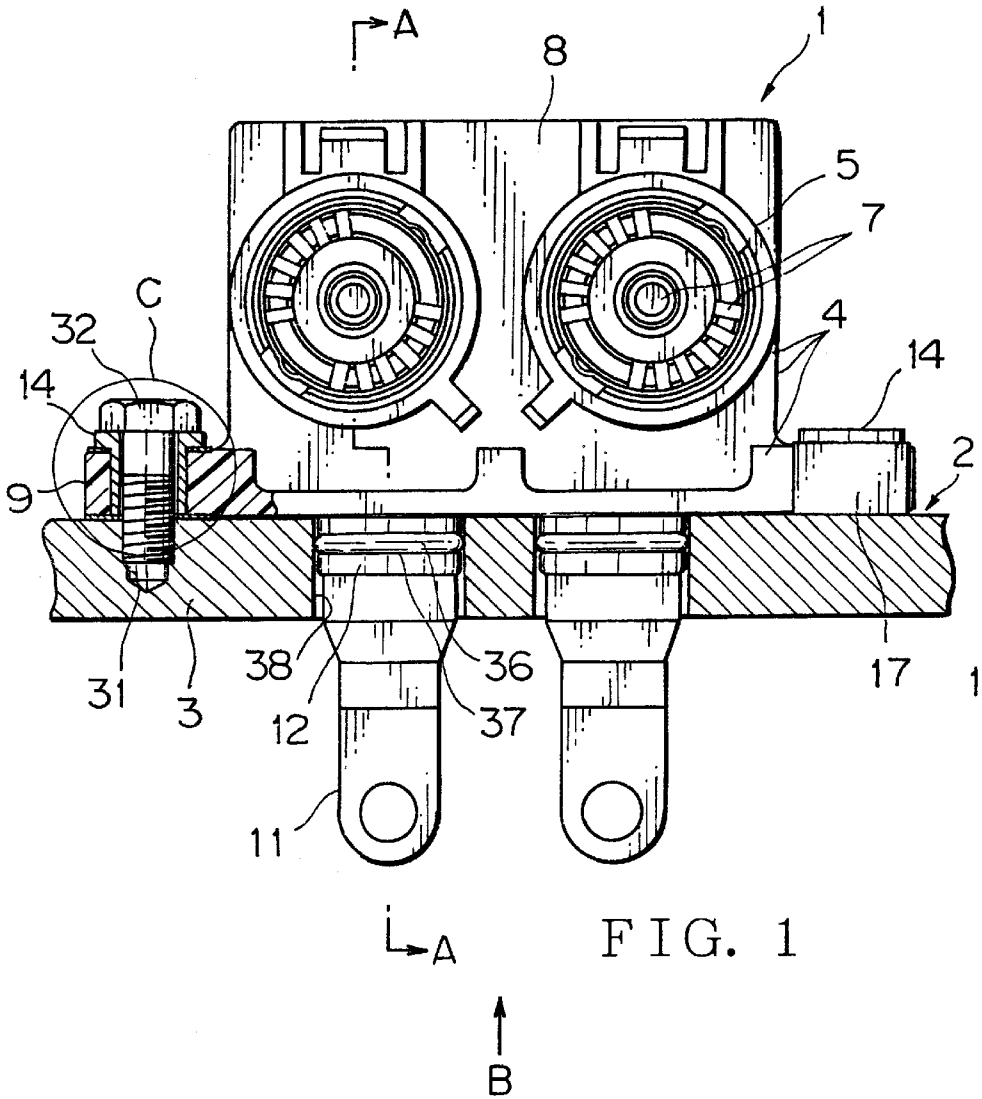
FIG. 1 is a front view partly in longitudinal section illustrating the first example of an electromagnetic shield connection mechanism according to the present invention.

In FIG. 1, there are shown a connector 1, which is directly attached to an equipment 2, and an equipment wall 3 made of electrically conductive metal provided on the equipment 2. The connector 1 includes a housing 4 made of synthetic resin, a cylindrical metal shield 6 (see FIG. 2) installed in a pair of cylindrical connector fitting sections 5 at the left and right of the housing 4, and a pin-shaped male terminal 7 at the center of the metal shield 6.

The connector fitting section 5 extends horizontally, the base of which is made as a continuation to a vertical base wall 8 which makes a right angle between a flange-shaped housing wall 9. A conductive plated layer is formed on the surface of the housing 4, i.e. the inner and outer surfaces of the connector fitting section 5, and the outer surface of the base wall 8 and the housing wall 9. The male terminal 7 in the connector fitting section 5 is formed in continuation to a busbar 10 in the base wall 8, and a tab 11 at the end of the busbar 10 sticks out from a boss 12 of the housing wall 9, being placed inside the equipment 2.

Figure 3:
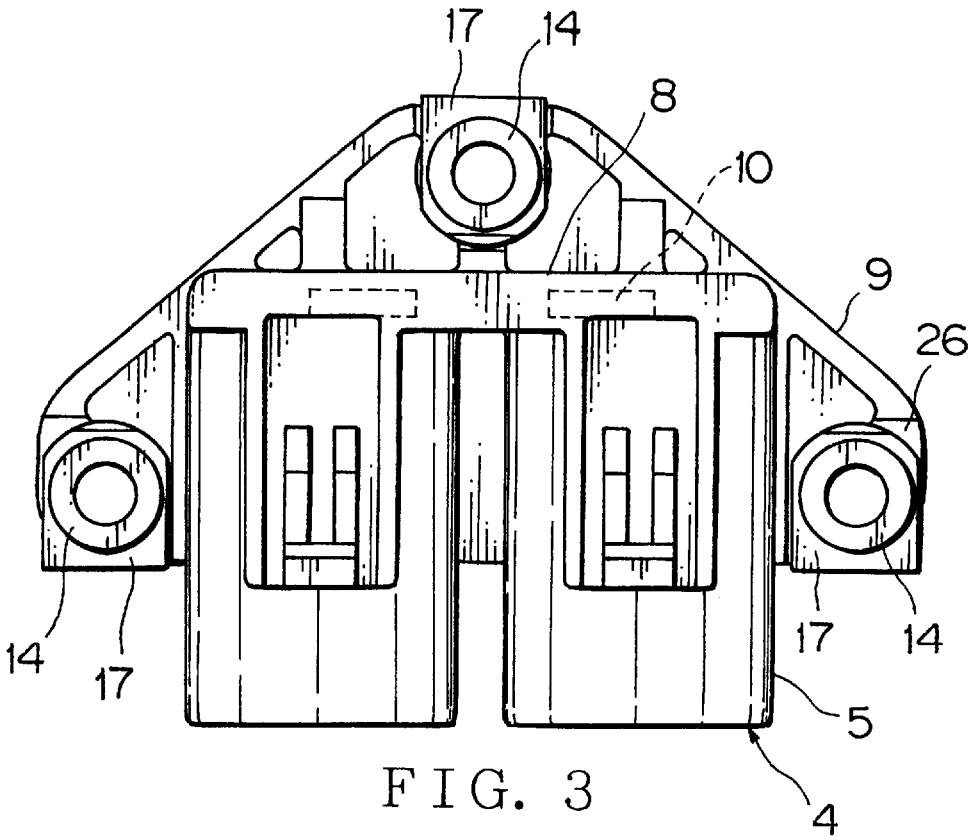
FIG. 3 is a top view illustrating the electromagnetic shield connection mechanism.
Figure 4:
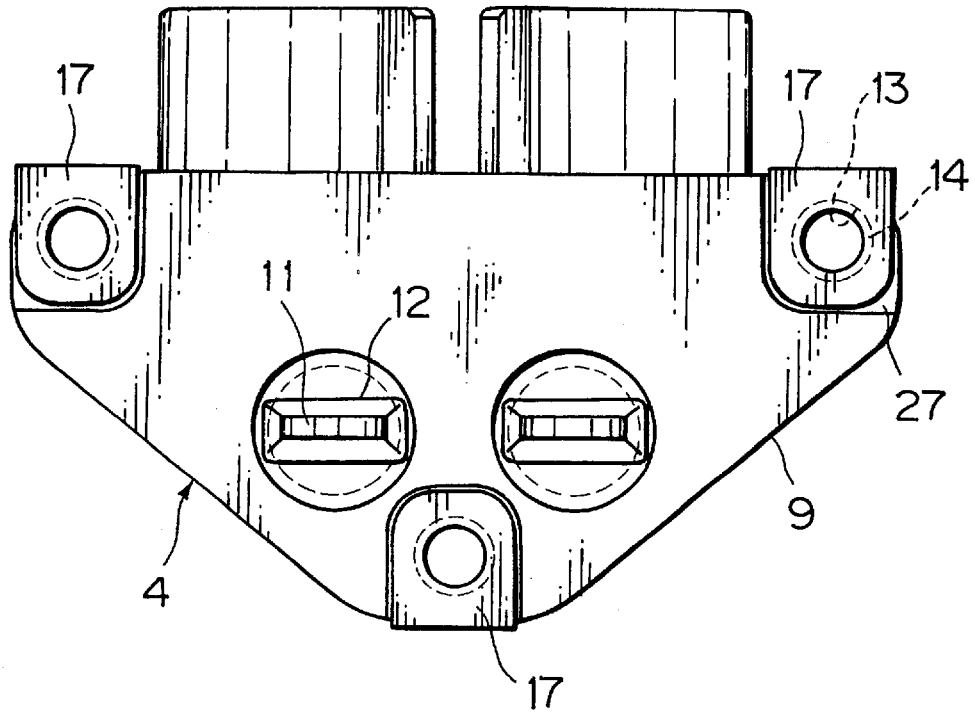
FIG. 4 is a view from arrow B (bottom view) of FIG. 1.
Figure 5:
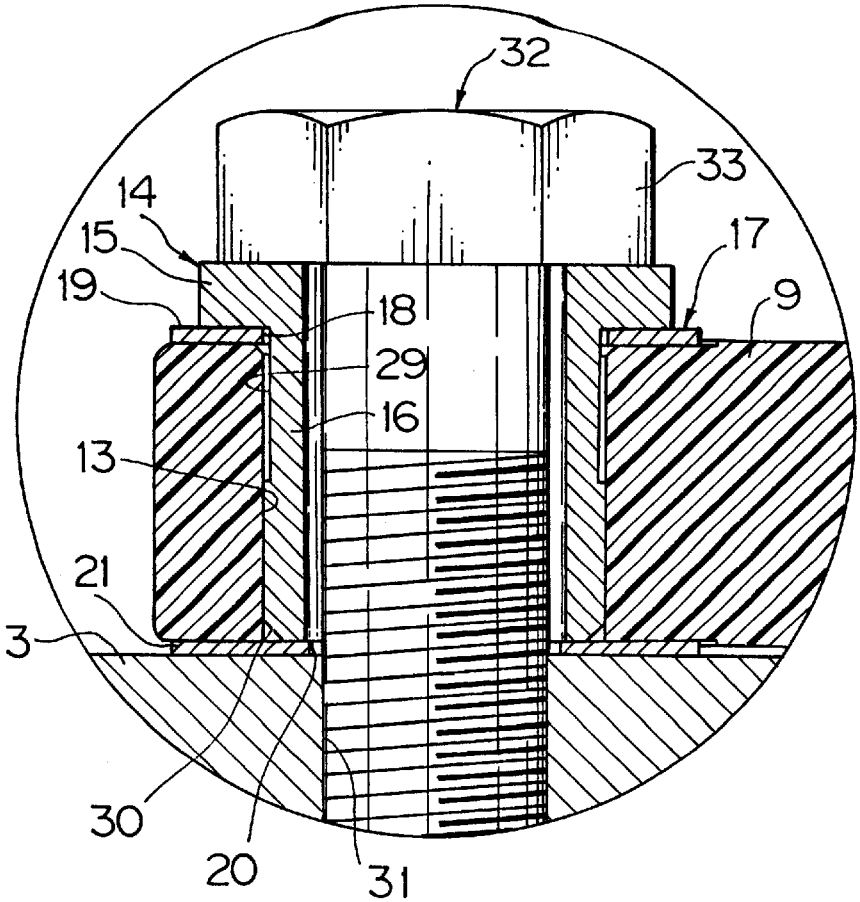
FIG. 5 is an enlarged view of portion C in FIG. 1.

As shown in FIGS. 3 and 4, the housing wall 9 is triangular-shaped, having a round hole 13 at each corner (see FIG. 5). A collar 14 made of electrically conductive metal is press-fitted into the each hole 13. This formation is disclosed in Japanese Patent Application Laid-Open H9-338694. The collar 14 is composed of a ring-shaped flange 15 at the upper portion and a cylindrical portion 16 formed vertically in continuation from the flange 15 (see FIG. 5). The bottom surface of the flange 15 and the end surface of the cylindrical portion 16 are into contact with a contact member 17 which is made of conductive metal and is U-shaped in the longitudinal section.

Figure 6:
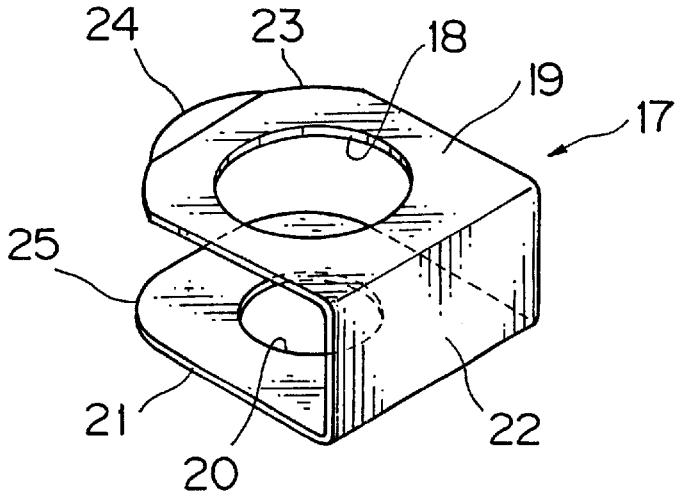
FIG. 6 is a perspective view illustrating a contact member.

As shown in FIG. 6, the contact member 17 is basically composed of an upper plate 19, a lower plate 21 and a vertical side plate 22, wherein the upper plate 19 has a large diameter collar-receiving hole 18 fitting with the cylindrical portion 16 of the collar 14, the lower plate 21 has a small diameter bolt-receiving hole 20 to be concentric with the collar-receiving hole 18, and the side plate 22 connects the upper plate 19 and the lower plate 21. The upper plate 19 and the lower plate 21 are faced and paralleled with each other.

The end of the upper plate 19 is formed with an arcuate shape and an upward tapered guide 24 is formed at the periphery of the semicircle portion, so that the contact member 17 is easy to be mounted to the housing hole 9 (see FIG. 3). Since the collar-receiving hole 18 is larger than the bolt-receiving hole 20, the upper plate 19 has more flexibility in the direction of the plate thickness than the lower plate 21. A corner 25 at the end of the lower plate 21 is chamfered to be an arc-shaped and the lower plate 21 is touchable to the equipment wall 3 (see FIG. 1) with a large contact area. Each of the upper plate 19 and the lower plate 21 has resiliency in the direction of the plate thickness.

As shown in FIGS. 3 and 4, the contact member 17 is inserted into the round hole 13 at each corner of the housing wall 9. The contact member 17 is significantly smaller than the housing wall 9 so that the insertion of the contact member 17 is very easy to be performed. The upper plate 19 and the lower plate 21 are resiliently fastened onto the upper face and the lower face of the housing wall 9, respectively. On the upper and lower faces of the housing wall 9, there are formed recessed portions 26 and 27, The depth of which is shallower than the thickness of the corresponding plates 19 and 21, respectively. The side plate 22 of the contact member 17 is in contact with the side of the housing wall 9.

A conductive plated layer is formed at least on the upper and lower faces of the housing wall 9 including a bearing surface of the hollow portion of fitting 26. The contact member 17 is in contact with the plated layer at least on the inside surface of the upper plate 19, preferably on the inside surface of the side plate 22 as well, so that the lower plate 21 is electrically connected to the plated layer. The contact member 17 is inserted at three spots of the housing wall 9, allowing the housing wall 9 to be in contact with the equipment wall securely without making an opening, through each contact member 17 and with three point support, resulting in that the electromagnetic shield connection between the housing wall 9 and the equipment 2 is securely achieved.

As shown in FIG. 5, the height of the cylindrical portion 16 of the collar 14 is set to be a sum of the plate thickness (depth of the round hole 13) of the housing wall 19 and the thickness of the upper plate 19 of the contact member 17. The inner diameter of the collar-receiving hole 18 of the upper plate 19 is substantially equal to the outer diameter (maximum diameter) of the cylindrical portion 16 of the collar 14. The upper portion 29 of the cylindrical portion 16 is recessed to be comparatively smaller diameter so as not to be in contact with the inner surface of the hole 13 of the housing wall 9, allowing only the lower portion of the cylindrical portion 16 to be in contact with the inner surface of the hole 13, resulting in that the press-fitting force needed is reduced.

The outer circumference of the lower end of the cylindrical portion 16 is chamfered at 30 for guiding to attain easy insertion. It is possible to form a conductive plated layer on the inner surface of the hole 13 of the housing wall 9. The bolt-receiving hole 20 of the lower plate 21 of the contact member 17 is formed to be comparatively smaller in diameter than the inner diameter of the collar 14, so that the bottom surface of the cylindrical portion 16 securely abuts against the lower plate 21 of the contact member 17. As shown in FIG. 5, the upper plate 19 and the lower plate 21 are the same in the plate thickness and the lower plate 21 is securely pressed onto the surface of the equipment wall 3 at the bottom surface (having small area) of the cylindrical portion 16.

A female screw hole 31 is formed on the equipment wall 3. The upper face of the flange 15 of the collar 14 abuts against the head 33 of the bolt 32 while the lower face of the flange 15 abuts against the upper plate 19 of the contact member 17. The outer width of the upper plate 19 is set to be a little larger than the outer diameter of the flange 15 which is set to be a little larger than the diameter of the bolt head 33. The conductive collar 14 electrically connects the upper plate 19 and the lower plate 21, contributing to an electrical conduction, thereby assisting the function of side plate 22. Even if the collar 14 is non-conductive, the side plate 22 electrically connects the plated layer on the upper face of the housing wall 9 and the lower plate 21, enabling grounding to the equipment side to be securely achieved.

Figure 2:
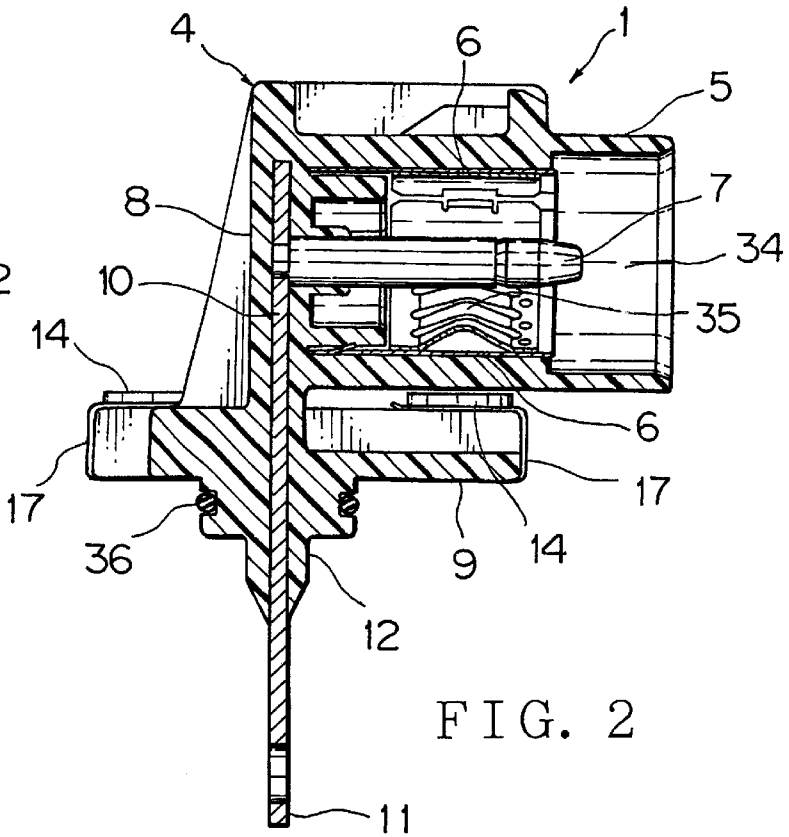
FIG. 2 is a cross section taken along A—A line in FIG. 1.

As shown in FIG. 2, the metal shield 6 in a fitting chamber 34 has a plurality of resilient pieces 35 on the inner surface of the chamber 34 so as to be resiliently in contact with a metal shield of a counter side connector (not shown). The metal shield 6 is finally connected to the equipment wall 3 made of conductive metal, after passing through the plated layers of inner and outer surfaces of the connector fitting section 5, the base wall 8 and the upper face of the housing wall 9, then through the upper plate 19, the side plate 22 and the lower plate 21 of the contact member 17 (see FIGS. 2, 5 and 6).

Due to a fastening force of the bolt 32, the flange 15 of the collar 14 strongly presses the upper plate 19 of the contact member 17 against the plated layer on the housing wall 9, then the cylindrical portion 16 of the collar 14 strongly presses the lower plate 21 against the equipment wall 3, resulting in high quality of the electromagnetic shield connection. Even if the housing wall 9 and the equipment wall 3 are deformed caused by substantial heat, a steady electromagnetic shield connection is obtained without being affected by such a hostile environment. In addition, the contact member 17, the housing wall 9 and the equipment wall 3 are closely fixed with each other due to heavy contact load caused by axial force of the bolt 32. Accordingly, the oxidation of the contact portion caused by an undesirable movement of contact members, which has been a problem for a conventional electromagnetic shield connection mechanism, is prevented so that no deterioration in quality of the contact takes place for a long time. In addition, since the bolt 32 is fastened through the collar 14, deformation, wear and damage of the housing wall 9 caused by the fastening force of the bolts 32 are substantially prevented.

As shown in FIG. 1, a groove 37 for fitting a ring-shaped packing 36 therein is formed at the boss 12 under the housing wall 9 so that the packing 36 is closely touched on an inner surface of the hole 38 provided at the equipment wall 3, preventing water or the like from penetrating into the equipment 2. The female screw hole 31 fitting with the bolt 32 is formed up to halfway in the equipment wall 3.

FIGS. 7 to 10 illustrate the second example of an electromagnetic shield connection mechanism according to the present invention.

It is an outline of the following electromagnetic shield connection mechanism that a metal shield 42 of a connector 41 directly connected with a motor is securely connected to an equipment wall (e.g. case) 44 of an equipment (e.g. motor) 43 by fastening a bolt 46 through a collar 45.

Figure 7:
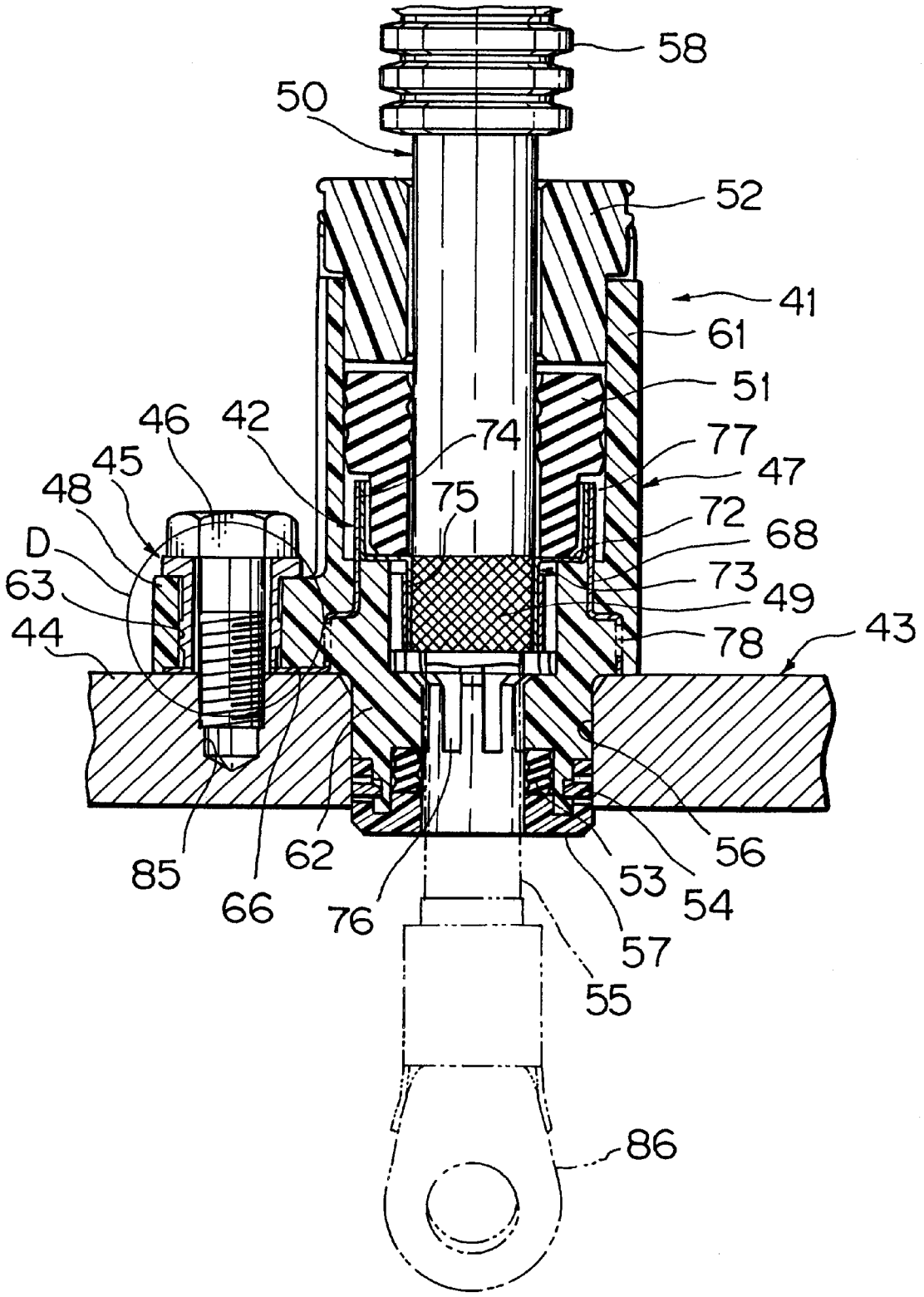
FIG. 7 is a longitudinal section illustrating the second example of an electromagnetic shield connection mechanism according to the present invention.
Figure 9:
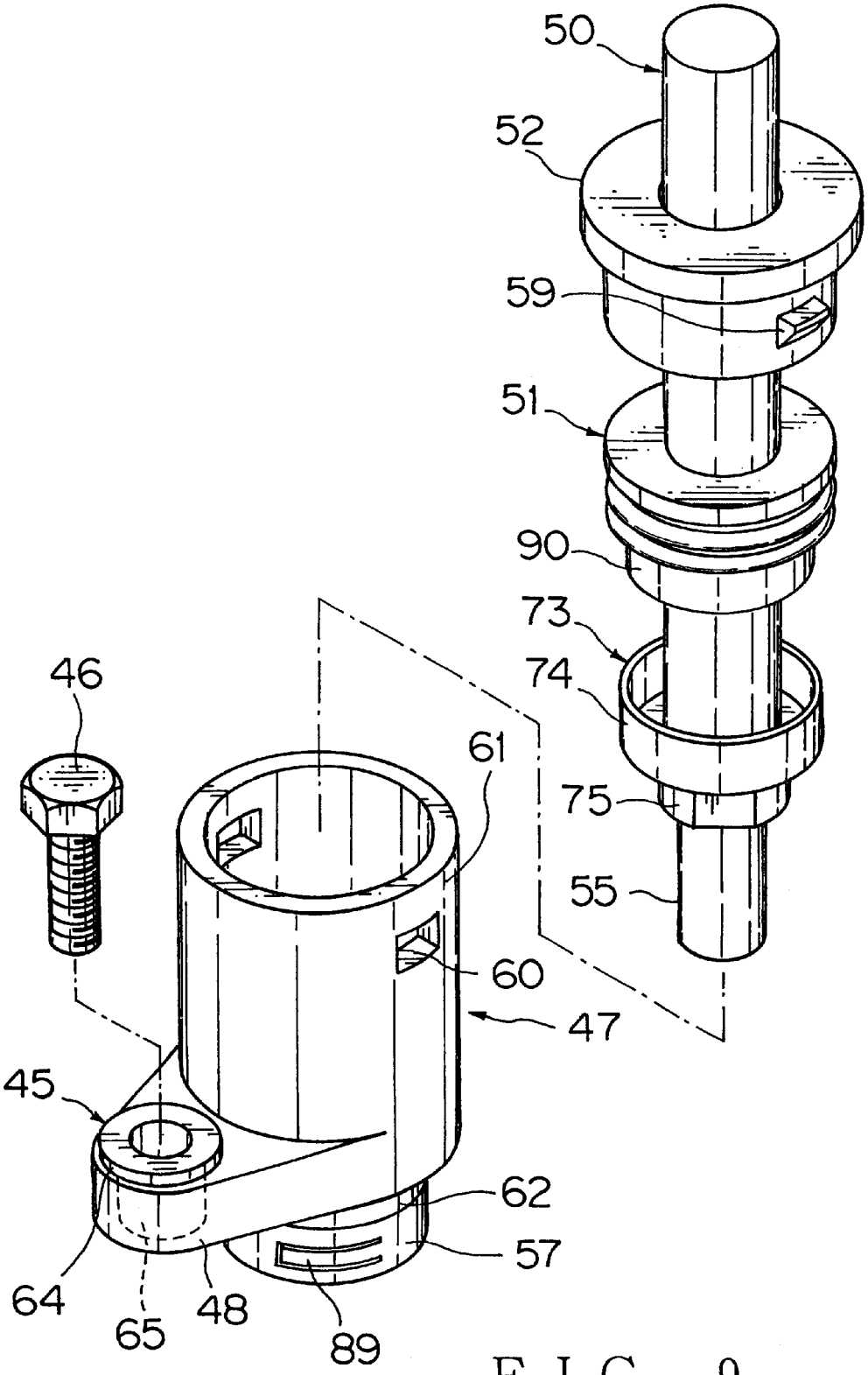
FIG. 9 is an exploded perspective view illustrating the electromagnetic shield connection mechanism.
Figure 11:
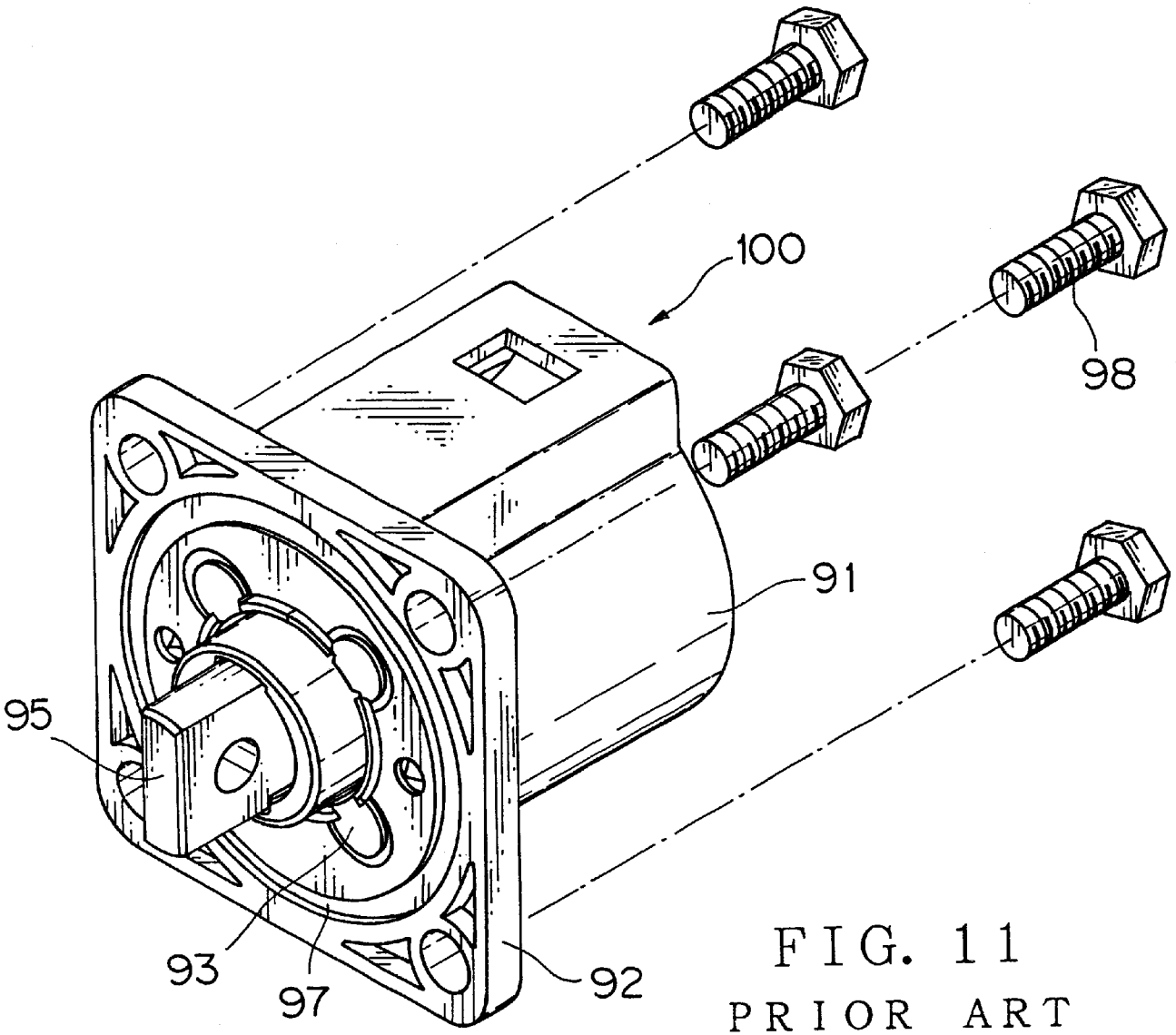
FIG. 11 PRIOR ART
FIG. 11 is a perspective view illustrating an example of conventional electromagnetic shield connection mechanism.
Figure 12:
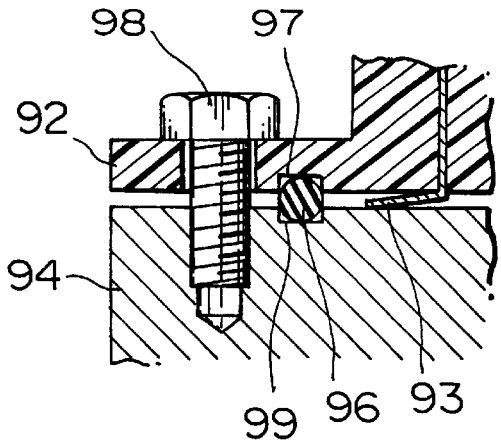
FIG. 12 PRIOR ART
FIG. 12 is a longitudinal section illustrating an example of conventional electromagnetic shield connection mechanism.
Figure 13:
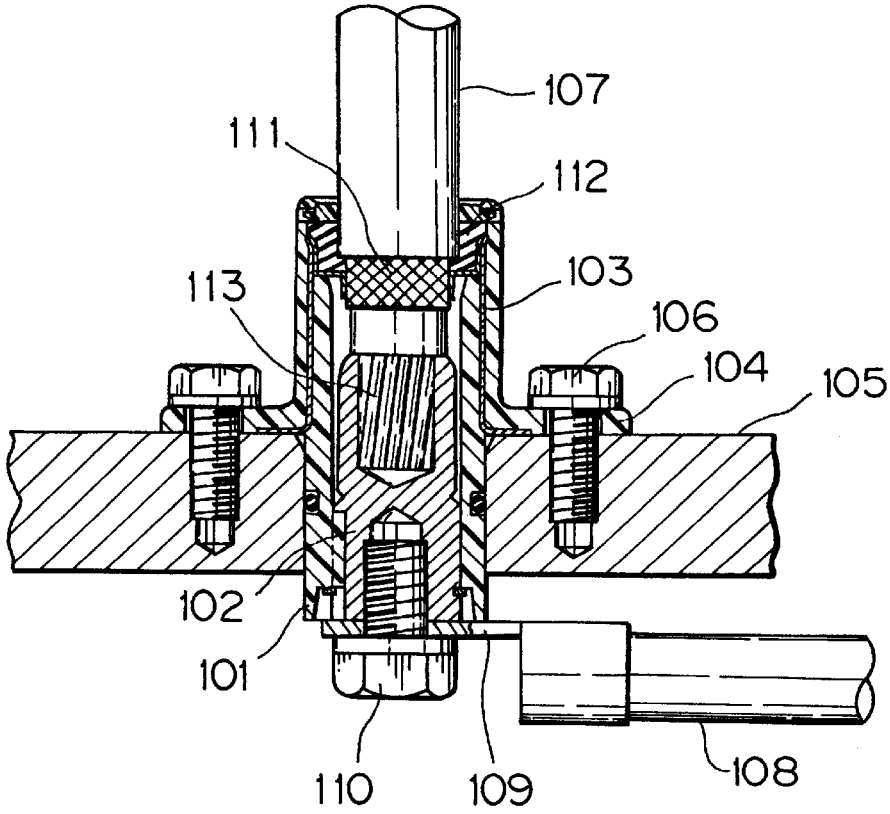
FIG. 13 PRIOR ART
FIG. 13 is a longitudinal section illustrating another example of conventional electromagnetic shield connection mechanism.

In FIGS. 7 and 9, there are shown a housing 47 made of synthetic resin having a flange-shaped housing wall 48, a metal shield 42 insert-molded within the housing 47, a ring-shaped connector 73 made of conductive metal connected to the metal shield 42, a braided shield (shielding portion) 49 of a shielded wire 50 connected to the connector 73, an waterproofing rubber stopper 51 inserted around the shielded wire 50, a rear holder 52 made of synthetic resin to prevent the rubber stopper 51 from coming out, packings 53 and 54 stuck to an inside covering 55 of the shielded wire 50 and an inner surface of a hole 56 formed at the equipment 43, a packing stopper 57, and a tube 58.

As shown in FIGS. 7 and 9, a connector 73 is composed of a large-diameter part 74, a middle part 72 and a small-diameter part 75, wherein an outer circumference surface of the large-diameter part 74 is in contact with the metal shield 42, a small-diameter part 90 of the rubber stopper 51 is fitted into the large-diameter part 74 of the connector 73, and the small-diameter part 75 of the connector 73 is crimp connected to the braided shield 49. A lock 89 locks the packing stopper 57 in the housing 47. The rear holder 52 is locked in the housing 47 by a piece 59 and a counter hole 60.

Figure 8:
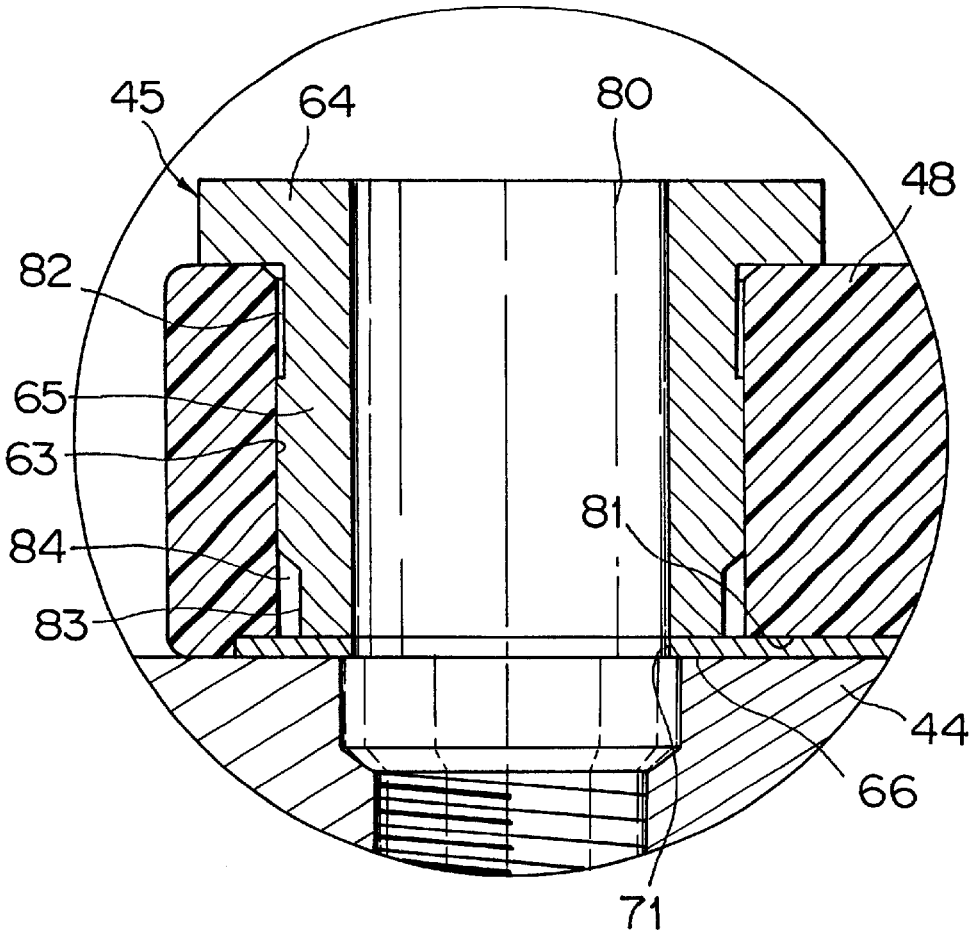
FIG. 8 is an enlarged view of portion D (a bolt not shown) in FIG. 7.

As shown in FIG. 9, the housing 47 is composed of a cylindrical part 61, a boss part 62 at an end of the cylindrical part 61, and a flange-shaped housing wall 48 extended laterally from nearly a middle position between the cylindrical part 61 and the boss part 62. Thus, the housing wall 48 is horizontally extended parallel to the equipment wall 44. The housing wall 48 has a round hole 63 in which the collar 45 made of conductive metal is press-fitted. As shown in FIG. 8, the collar 45 is composed of a ring-shaped flange 64 and a cylindrical portion 65, as is the case with the first example. The bottom end of the cylindrical portion 65 abuts against a flange-shaped contact plate 66 of the metal shield 42 (see FIG. 7). The metal shield 42 is pressed against the equipment wall 44 by the collar 45.

Figure 10:
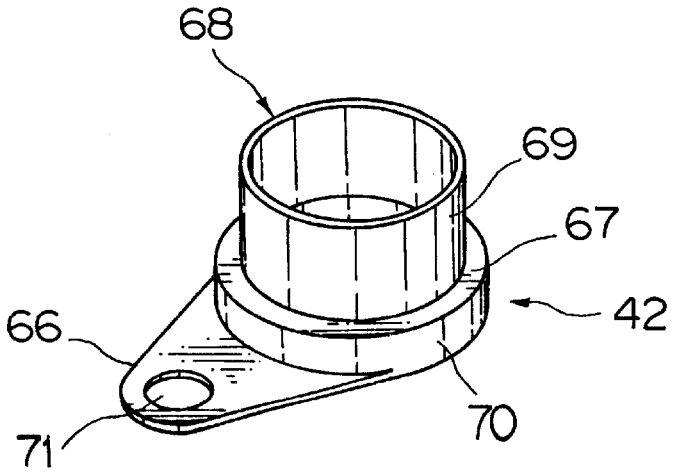
FIG. 10 is a perspective view illustrating a metal shield.

As shown in FIG. 10, the metal shield is composed of a ring 68, a step 67 and the contact plate 66 extended laterally from the bottom of the ring 68, wherein the ring 68 is composed of a small-diameter part 69 and a large diameter part 70, and the plate 66 has a bolt insertion hole 71. The plate 66 is formed to have the same or small size compared to the housing wall 48 of the housing 47 (see FIG. 9) and positioned so as to abut on a lower surface of the housing wall 48.

As shown in FIG. 7, the ring-shaped connector 73 is connected to an inside of the ring 68 of the metal shield 42. The large-diameter part 74 of the connector 73 is in face contact with the small diameter part 69 of the ring 68, while the small-diameter part 75 is crimp-connected to the braided shield 49. The small-diameter part 75 has a piece 76, which supports an inside covering 55 of the shielded wire 50.

The upper portion of the small-diameter part 69 of the metal shield 42, which is in close contact with the large-diameter part 74 of the connector 73, is placed in a space 77 in the housing 47. The lower portion of the small-diameter part 69, the step 67 and the large-diameter part 70 are mold-shaped into one united body. The contact plate 66 is exposed and placed along the bottom surface of the housing wall 48. The large-diameter part 70 has a hole 78 for pouring resin thereinto.

As shown in FIG. 8, the bolt insertion hole 71 of the contact plate 66 is formed so that the hole size is substantially the same as that of the bolt insertion hole 80 of the collar 45. The plate 66 is placed in an opening 81 of the housing wall 48 and the bottom surface of the housing wall 48 touches the upper surface of the plate 66. The plate 66 is pressed against the equipment wall 44 by the end surface of the cylindrical portion 65 of the collar 45. The flange 64 of the collar 45 abuts on the upper surface of the housing wall 48. The upper part of the cylindrical portion 65 is notched to give a small diameter there, thereby reducing a force needed when the collar 45 is press-fitted into the hole 63 of the housing wall 48.

The outer circumference of the press-fitting end of the cylindrical portion 65 is notched to give a small diameter there compared to the other part of the cylindrical portion 65, so that a ring-shaped hollow (opening) 84 for a scrap to be collected therein is provided between an outer circumference surface of this small-diameter portion 83 and that of the hole 63. The scrap is formed as the inner wall of the hole 63 is scraped off when the collar 45 is press-fitted in the hole 63. Thus, receiving scrap into the opening 84 prevents the following problems from taking place that the scrap is caught in between the bottom end of the cylindrical portion 65 and the plate 66 or is jammed in between the bolt 46 and the female screw hole 85.

As shown in FIGS. 7 and 8, the flange 64 of the collar 45 is pressed downward by the head of the bolt 46 and the plate 66 of the metal shield 42 is strongly pressed onto the equipment wall 44 by the bottom end of the cylindrical portion 65, resulting in that the braided shield 49 of the shielded wire 50 is securely grounded through the equipment 43. Consequently, even if the housing wall 48 is deformed with time caused by heat and so on, the shield performance of the connector 41 is not deteriorated. The collar 45 made of metal is not influenced by heat.

As shown in FIG. 7, the inside covering 55 of the shielded wire 50 extends from an end of the housing 47, a male terminal 86 is crimp connected to a core (not shown) within the covering 55 and a circuit (not shown) of the equipment side is connected to the male terminal 86. The boss 62 at the end of the housing 47 is fitted in the hole 56 of the equipment wall 44 and the packing 54 is closely pressed onto the inner circumference of the hole 56. Since the boss 62 is engaged in the hole 56, the single housing wall 48 is sufficient enough to securely hold the connector 41 onto the equipment wall 44.

Without using the packing 53 and the packing stopper 57, only a packing 54 such as O-ring around the outer circumference of the boss 62 may be used. In FIG. 8, a ring-shaped opening 84 for a scrap to be collected therein may be provided by notching a circumference surface of the hole 63 of the housing wall 48 instead of notching the collar 45. The ring-shaped opening is also applicable to the collar 14 (FIG. 5) for the first example of the present invention. The collar 45 for the second example of the present invention may have no flange. The metal shield 42 may separately be assembled in the housing 47, instead of using the insert-molding method.

What is claimed is:

1. An electromagnetic shield connection mechanism for a structure in which a wall of a housing is fixed to equipment, said mechanism comprising:

a hole formed in said housing wall, a headed bolt extending through said hole in said housing wall for securing said mechanism to said equipment, an electrically conductive collar having a hollow cylindrical body concentrically disposed between said bolt and the wall of said hole, a contact member of substantial C-shape in section and having one plate portion engaging said collar and another plate portion, spaced from said one plate portion, engaging said equipment and being operative to establish electrical contact between said collar and said equipment; and said collar having means for pressing said another plate portion of said contact member against said equipment.

2. The electromagnetic shield connection mechanism according to claim 1, including an electrically conductive layer disposed on a surface of the housing in contact with the contact member.

3. The electromagnetic shield connection mechanism according to claim 2, wherein the contact member has a pair of mutually spaced plates disposed in facing relation with respect to each other, one of said plates having a collar-receiving hole, the other of said plates having a bolt-receiving hole, and the each plate being kept in contact with an adjacent surface of the housing wall.

4. The electromagnetic shield connection mechanism according to claim 3, wherein the contact member is mounted at three mutually spaced locations of the housing wall.

5. The electromagnetic shield connection mechanism according to claim 1, wherein the contact member having a bolt-receiving hole is integrally formed with a metal shield.

6. The electromagnetic shield connection mechanism according to claim 5, wherein the metal shield is connected to a shielding portion of a shielded wire.

7. The electromagnetic shield connection mechanism according to claim 1, wherein the collar is composed of a flange part and a cylindrical part.

8. The electromagnetic shield connection mechanism according to claim 2, wherein the collar includes a flange part integrally formed on said cylindrical body.

9. The electromagnetic shield connection mechanism according to claim 5, wherein the collar includes a flange part integrally formed on said cylindrical body.

10. The electromagnetic shield connection mechanism according to claim 1, wherein an annular hollow is provided at a press-fitting end of the collar.

11. The electromagnetic shield connection mechanism according to claim 2, wherein an annular hollow is provided at a press-fitting end of the collar.

12. The electromagnetic shield connection mechanism according to claim 5, wherein an annular hollow is provided at a press-fitting end of the collar.

13. The electromagnetic shield connection mechanism according to claim 7, wherein an annular hollow is provided at a press-fitting end of the collar.

14. The electromagnetic shield connection mechanism according to claim 8, wherein an annular hollow is provided at a press-fitting end of the collar.

15. The electromagnetic shield connection mechanism according to claim 9, wherein an annular hollow is provided at a press-fitting end of the collar.

* * * * *